US005722375A

United States Patent [19]

Nally et al.

[11] Patent Number: 5,722,375

[45] Date of Patent: Mar. 3, 1998

[54] EXTENDED TIP AIR ASSIST FUEL INJECTOR

[76] Inventors: Debora Nally, 2270 W. Island Rd., Williamsburg, Va. 23185; Jingming J. Shen, 907 Elder Rd., Newport News, Va. 23602; William A. Peterson, Jr., 11183 Eagle Watch, Smithfield, Va. 23430; John F. Nally, 2270 W. Island Rd., Williamsburg, Va. 23185

[21] Appl. No.: 437,908

[22] Filed: May 10, 1995

[51] Int. Cl.[6] ..... F02M 23/00

[52] U.S. Cl. ..... 123/531

[58] Field of Search ..... 123/531, 412, 123/DIG. 7, DIG. 6, 470, 533; 239/533.12

[56] References Cited

U.S. PATENT DOCUMENTS

| | | | |
|---|---|---|---|
| 4,434,766 | 3/1984 | Matsuoka et al. | 123/472 |
| 5,174,505 | 12/1992 | Shen | 239/417.03 |
| 5,224,458 | 7/1993 | Okada et al. | 123/531 |
| 5,419,297 | 5/1995 | Peterson, Jr. et al. | 123/470 |
| 5,449,120 | 9/1995 | Tani et al. | 239/397.5 |
| 5,551,400 | 9/1996 | Rice et al. | 123/470 |
| 5,577,666 | 11/1996 | Shen | 239/290 |

*Primary Examiner*—Raymond A. Nelli
*Attorney, Agent, or Firm*—Russel C. Wells

[57] ABSTRACT

A shroud member for converting an extending tip fuel injector into an air assist fuel injector wherein the air metering is performed at a distance remote from the O-ring seals holding the injector into the engine manifold.

6 Claims, 2 Drawing Sheets

EXTENDED TIP AIR ASSIST FUEL INJECTOR

FIELD OF INVENTION

This invention relates to fuel injectors in general and more particularly to air assisted fuel injectors.

BACKGROUND OF INVENTION

It is the function of air assist fuel injectors to atomize the fuel into smaller droplets to provide a better combustion process and to minimize the emissions components of the exhaust gas from those which might be found in non-air assisted fuel systems.

Engine emission requirements have driven the need to achieve better atomization of the fuel by breaking up the fuel into small droplet sizes that result in more thorough or efficient combustion. To accomplish this, additional air at sonic velocity is aimed at the fuel and the impact of the air results in the air energy braking up the fuel droplets into droplets of a fine mist which is then aimed at the intake valve.

This has been fairly well accomplished for some engine designs, by allowing the point of air metering exit to be out in the open air stream. However, some engine designs place the point of air metering back in a recessed pocket or anti chamber. This typically occurs due to the geometry necessary to incorporate the air flow passage in the manifold or head, or due to the need to produce the air assist injector in a pod shaped housing with an external air feed connection.

The drawbacks of having the air metering exit point in an anti chamber include poor targeting capability resulting in the atomized fuel being inadequately aimed at the intake valve or valves and the potential that the finely atomized mist that an air assist injector produces will condense on the runner wall. Both of which results in a penalty on emissions and derivability.

The previous solutions require wall wetting compromises to be made in the calibration of the engine and subsequent emission control philosophy.

SUMMARY OF THE INVENTION

The solution herein allows a multipoint extended tip air assist injector to have the air metering point located at the fuel metering point and together each are substantially removed from the sealing geometry of the injector and the manifold in which it is mounted. The result allows optimizing of the targeting for the fuel and the cylinder. The atomized fuel from the injector is capable of being swept into the air steam and wall wetting and its subsequent emission and vehicle derivability problems are minimized. In addition the fuel charge can be aimed at the intake valve(s) of the engine.

An air assisted electromechanical fuel injector for an internal combustion engine having an inlet for the reception of fuel into the injector and an outlet at one end of the injector for discharging fuel into the manifold of the engine. Adjacent the fuel outlet in the valve body is a fuel metering valve which is operated by an electromagnetic means for opening and closing valve. An air supply means provides air to the injector. A shroud member is located on the injector and in a top feed injector, extends from the outlet to a point intermediate the inlet and the outlet of the injector. The shroud member cooperates with the injector, more particularly with the valve body, to define air passageways between the valve body and the inside of the shroud means for the passage of air. An air inlet means in the shroud member is adapted to be in fluid communication with air supply means in the manifold for connecting the air supply means, through the air passageways to a discharge point adjacent to but downstream of the outlet of the fuel metering valve. Sealing means is located in cooperative relationship with the shroud member and the manifold and are axially spaced on either side of the air inlet means.

In all embodiments, the air assisted electromechanical fuel injector may be either a top feed injector or a bottom feed injector and in each instance the design of the shroud member is modified to accommodate the fuel feed, air feed and sealing requirements.

In one embodiment the air assisted electromechanical fuel injector has its fuel metering valve located in the air stream of the manifold of the engine and fuel metering and air metering are located adjacent to the outlet of the injector in the air stream.

In still another embodiment, the air assisted electromechanical fuel injector additionally includes conduit means for connecting the air inlet means to the air supply means.

DETAILED DESCRIPTION

Figure 1:
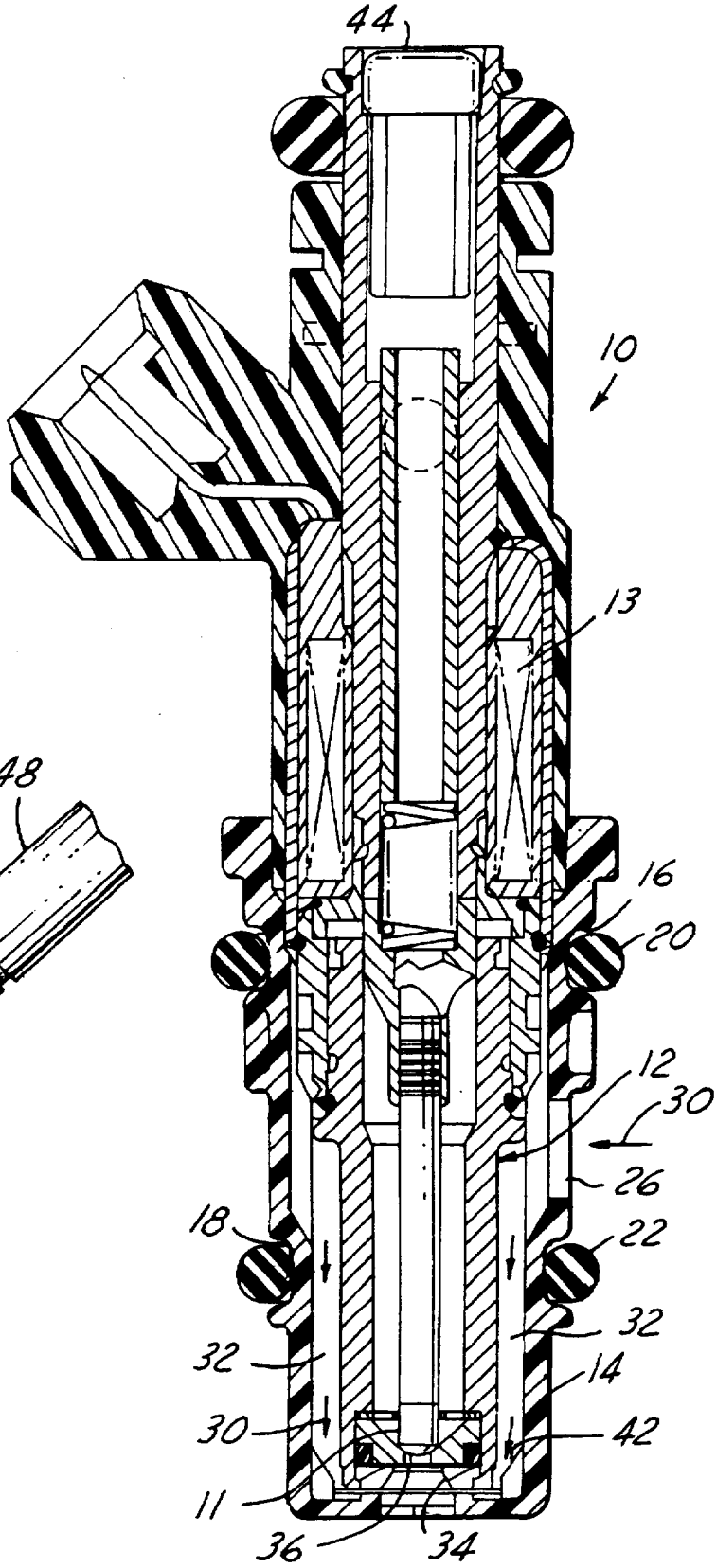
FIG. 1 is a cross sectional view of an extended tip fuel injector with air assist.

In FIG. 1 there is illustrated a fuel injector 10 as is described in U.S. patent application having Ser. No. 08/268,004 and entitled "Extended Tip Gasoline Port Fuel Injector". The operation of an such a fuel injector 10 is well known and will not be repeated. The fuel metering valve 11 is located at the end of the valve body 12 and is operated by an electromagnetic means such as a coil 13. Around the outside of the valve body 12 there is illustrated a shroud member 14 which is used to convert the fuel injector into an air-assist fuel injector. The shroud member 14 is similar to that found in U.S. Pat. No. 5,174,505, entitled Air Assist Atomizer for Fuel Injector dated Dec. 29, 1992 by J. J. Shen with the exceptions duly detailed hereinafter.

Figure 2:
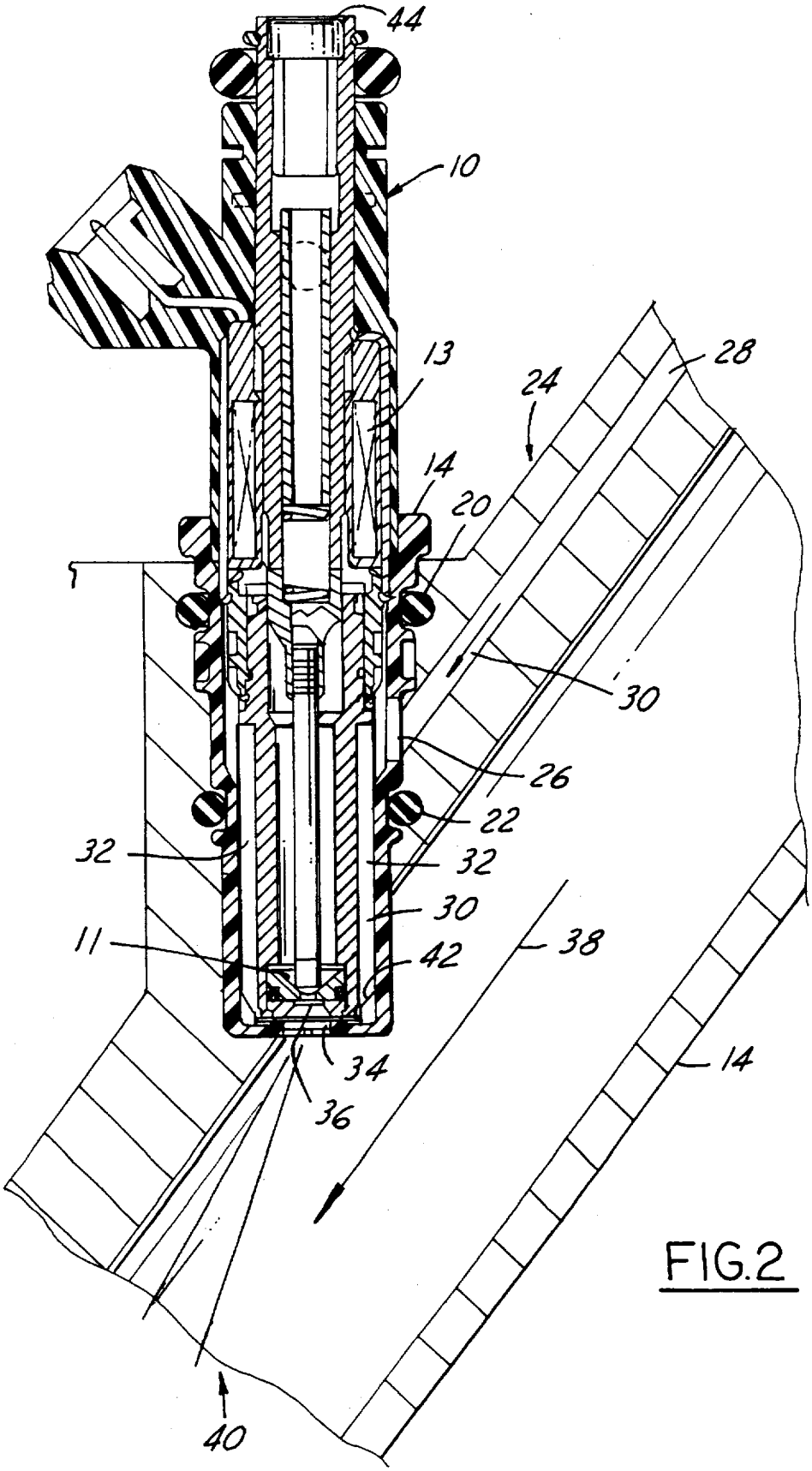
FIG. 2 is a cross sectional view of an air assisted extended tip fuel injector in a manifold.

In the preferred embodiment, the shroud member 14 provides annular pockets 16, 18 for containing O-ring seals 20, 22. The O-rings function, as illustrated in FIG. 2 to seal the injector 10 in the manifold 24. In addition, the shroud member 14 has an air inlet port 26 for receiving air from an air passageway 28 in the manifold 24 as illustrated in FIG. 2. Arrows 30 in both FIGS. show the flow of the air through the air passageways 32 between the shroud member 14 and the valve body 12 from the air inlet port 26.

The concept in this invention is to position the point of air metering 34 some distance from the lower seal 22 of the injector in the manifold 24 so that the fuel is atomized adjacent to the fuel metering tip 36 and at the point of the insertion of the fuel into the air stream 38 flowing in the manifold. In particular, FIG. 2 shows the application of the injector 10 of FIG. 1 in an bent stream application wherein the fuel is directed to the intake valve 40 of the engine.

Between the shroud member 14 and the valve body 12 of the injector 10 there is an air passageway 32 directing the flow of air from the manifold air passageway 28 through the air inlet port 26. The outline of the valve body 12 can contain a plurality of ribs or can be smooth so long as there exists the air passageway 32. At the end 42 of the air passageway 32, the air is directed to the outlet of the injector for mixing with the fuel to create the fine mist.

The shroud member 14 is a molded plastic member, or in the alternative may be fabricated as a sintered metal member, and is secured to the injector and is held in the manifold by various means. A top feed fuel injector is also secured to the manifold by the location of the fuel rail, not shown, which supplies fuel to the inlet of the injector. The injector 10 of FIG. 1 being a top feed injector receives fuel from a fuel rail secured to the top of the injector. The concept of the air assist being supplied to the point of the fuel metering is also applicable to a bottom feed injector and the shroud additionally provides means for the inlet of fuel into the injector. In such a case, another set of O-rings will be provided to separate both the fuel and the air passages and to seal the injector into the manifold or similar engine component.

The air metering function can be fabricated by means of one or more air disks at the end of the shroud member 14 as illustrated in U.S. Pat. No. 5,174,505, or it may be accomplished by one or more apertures. In each embodiment the air, at sonic velocity, is directed to the fuel ejected from the fuel metering tip 11 of the injector.

Figure 3:
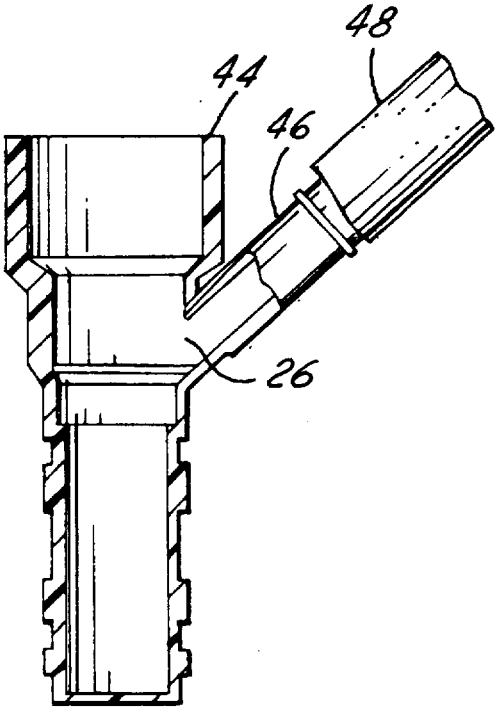
FIG. 3 is a cross section view of an air assisted pod member.

FIG. 3 illustrates a pod member 44 which may be attached to the injector 10. The pod member 44 includes a tubular extension 46 from the air inlet means 26. A conduit member may be attached to the tubular extension for connecting the air inlet means 26 to an air supply means.

What is claimed is:

1. An air assisted electromechanical fuel injector for an internal combustion engine having an inlet for the reception of fuel into the injector and an outlet at one end of the injector for discharging fuel into the manifold of the engine, adjacent the outlet is a fuel metering valve which is operated by an electromagnetic means for opening and closing valve, and air supply means; comprising:

a shroud member located on the injector and extends from the outlet to a point intermediate the inlet and the outlet of the injector, said shroud member cooperates with the injector to define air passageways between the injector and the inside of the shroud member for the passage of air;

air inlet means in said shroud member adapted to be in fluid communication with the air supply means for connecting the air supply means, through the air passageways to a discharge point adjacent to but downstream of the outlet of the fuel metering valve; and, sealing means located in cooperative relationship with the shroud member and axially spaced on either side of said air inlet means.

2. An air assisted electromechanical fuel injector according to claim 1 wherein the fuel injector is a top feed injector.

3. An air assisted electromechanical fuel injector according to claim 1 wherein the fuel injector is a bottom feed injector.

4. An air assisted electromechanical fuel injector according to claim 1 wherein the fuel metering valve of the injector is located in the air stream of the manifold of the engine and the fuel metering and air metering are located adjacent to the outlet of the injector in said air stream.

5. An air assisted electromechanical fuel injector according to claim 1 additionally including conduit means for connecting said air inlet means to the air supply means.

6. An air assisted electromechanical fuel injector according to claim 1, wherein said shroud member is a molded plastic member.

* * * * *